US005238589A

United States Patent [19]

Pratt et al.

[11] Patent Number: 5,238,589

[45] Date of Patent: Aug. 24, 1993

[54] POLYUREA GREASE COMPOSITION

[75] Inventors: Samuel Pratt, Port Arthur; Edward A. Fliss, Humble, both of Tex.

[73] Assignee: Texaco Inc., White Plains, N.Y.

[21] Appl. No.: 987,847

[22] Filed: Dec. 9, 1992

[51] Int. Cl.[5] ..... C10M 115/08

[52] U.S. Cl. ..... 252/51.5 A; 252/51.5 R

[58] Field of Search ..... 252/18, 25, 51.5 A, 252/51.5 R

[56] References Cited

U.S. PATENT DOCUMENTS 4,104,177 8/1978 Caruso ..... 252/51.5 A
4,115,284 9/1978 Kinoshita et al. ..... 252/51.5 A
4,481,367 11/1984 Knopf ..... 252/51.5 A
4,521,330 6/1984 Olstowski et al. ..... 252/51.5 A
5,094,765 3/1992 De Rosa et al. ..... 252/51.5 R
5,110,489 5/1992 Stadler et al. ..... 252/51.5 A
5,145,591 9/1992 Kinoshita et al. ..... 252/51.5 A

*Primary Examiner*—Jacqueline V. Howard
*Attorney, Agent, or Firm*—Jack H. Park; Kenneth R. Priem; Richard A. Morgan

[57] ABSTRACT

A polyurea grease composition is prepared by reacting a diisocyanate with a monoamine and a diamine in the presence of a polyoxyethylene/polypropylene glycol copolymer having a molecular weight of 300 to 15,000 or an alkoxylated alkylene diamine having a molecular weight of 500 to 18,000. The resulting grease composition demonstrates resistance to water absorption and improved yield (low penetration number vs. high).

14 Claims, No Drawings

POLYUREA GREASE COMPOSITION

BACKGROUND OF THE INVENTION

1. Field of the Invention

The invention relates to a polyurea grease composition comprising a lubricating oil and a thickener. The thickener is the reaction product of a diisocyanate with a monoamine, a diamine and a selected copolymer. The copolymer is either a polyoxyalkylene glycol or a polyoxyalkylene diamine.

2. Description of Other Related Methods in the Field

Polyurea grease compositions are used commercially to provide lubrication at high temperature for extended periods of time. The polyurea thickening agents are formed by reacting an isocyanate with an amine mixture in a base oil to yield the polyurea grease composition.

U.S. Pat. No. 4,661,276 to J. E. Stemke discloses a polyurea thickened grease in which the amine component is selected from the group consisting of polyesters, polyamides, polyurethanes, polyamines or polyoxides.

U.S. Pat. No. 3,801,506 to E. A. Cross et al discloses greases thickened with lithium soaps or mixtures of lithium soaps and calcium soaps. One additive to the grease composition is a copolymer of polyoxyethylene glycol and polyoxypropylene glycol. The copolymers comprise 75 to 90 parts by weight of propoxy groups and 25 to 10 parts by weight ethoxy groups. Molecular weights range from 300 to 15,000. The finished grease comprises 0.1 wt % to 5 wt % of the copolymer.

SUMMARY OF THE INVENTION

A grease composition comprises a lubricating oil and a polyurea thickener. The thickener is prepared by reacting a diisocyanate compound with a monoamine, a diamine and a selected copolymer. A polyoxyethylene/polyoxypropylene phenol copolymer has a molecular weight of 300 to 15,000. A polyoxyethylene/polyoxypropylene diamine copolymer has a molecular weight of 500 to 18,000.

The grease composition demonstrates reduced water adsorption and improved yield.

DESCRIPTION OF THE PREFERRED EMBODIMENTS

The polyurea thickener of the invention is formed by the reaction of a diisocyanate, a monoamine, a diamine and a copolymer in lubricating oil. The copolymer is either a glycol of polyoxyethylene and polyoxypropylene or a diamine of polyoxyethylene and polyoxypropylene.

The grease reaction is carried out by contacting the four reactants in a reaction vessel, at a temperature between about 60° F. and 320° F., preferably 100° F. to 300° F. for a period of from 0.5 hours to 5 hours, preferably 1 hour to 3 hours. The reaction vessel is typically a grease kettle, which may be operated as a batch reactor or as a continuous stirred tank reactor (CSTR).

The monoamine used in the formulation of the polyurea will form the terminal end groups. These terminal end groups will have from 1 to 30 carbon atoms, but are preferably from 5 to 28 carbon atoms, and more desirably from 10 to 24 carbon atoms.

Illustrative of various monoamines are pentylamine, hexylamine, heptylamine, octylamine, decylamine, dodecylamine, tetradecylamine, hexadecylamine, octadecylamine, eicosylamine, dodecenylamine, hexadecenylamine, octadecenylamine, octadecadienylamine, abietylamine, aniline, toluidine, naphthylamine, cumylamine, bornylamine, fenchylamine, tertiary butyl aniline, benzylamine, β-phenethylamine, etc. Particularly preferred amines are prepared from natural fats and oils or fatty acids obtained therefrom. These starting materials can be reacted with ammonia to give first amides and then nitriles. The nitriles are then reduced to amines, conveniently by catalytic hydrogenation. Exemplary amines prepared by the method include stearylamine, laurylamine, palmitylamine, oleylamine, petroselinylamine, linoleylamine, linolenylamine, eleostearylamine, etc. The unsaturated amines are particularly preferred.

The diamines which form the internal hydrocarbon bridges between the ureido groups usually contain from 2 to 40 carbons and preferably from 2 to 30 carbon atoms, more preferably from 2 to 20 carbon atoms. Exemplary diamines include ethylenediamine, propanediamine, butanediamine, hexanediamine, dodecanediamine, octanediamine, hexadecanediamine, cyclohexanediamine, cyclooctanediamine, phenylenediamine, tolylenediamine, xylylenediamine, dianiline methane, ditoluidinemethane, bis(aniline), bis(toluidine) and piperazine.

Representative examples of diisocyanates include hexane diisocyanate, decanediisocyanate, octadecanediisocyanate, phenylenediisocyanate, tolylenediisocyanate, bis(diphenylisocyanate), methylene bis(phenylisocyanate), etc.

The copolymers of the invention are described in U.S. Pat. No. 3,801,506 to E. A. Cross and G. S. Bright incorporated herein by reference. The polyoxyalkylene glycol copolymers have an average molecular weight of about 300 to about 15,000. The polyoxyalkylene diamines have an average molecular weight of 500 to 18,000. The preferred copolymers contain from about 50 to 75 parts by weight of propoxy groups and from 25 to 50 parts by weight of ethoxy groups and have an average molecular weight of from about 1500 to about 10,000. These copolymers are sold by Witco Chemical Company as Witbreak DPG ®-15. Witbreak DPG ®-15 contains about 75 to 90 parts by weight of propoxy groups and from about 25 to 10 parts by weight ethoxy groups. The preferred polyoxyalkylene diamine has an average molecular weight of about 3000 to 12,000, comprises 75 to 90 parts by weight propoxy groups and 25 to 10 parts by weight ethoxy groups and is sold by Petrolite Industrial Chemicals as Tolad ® 9302.

The copolymer is employed in an effective amount to substantially increase the resistance of the grease composition to water. The amount will vary according to the substituents of the polyurea component. In general 0.1 parts by weight to 5.0 parts by weight of copolymer per hundred parts by weight of the finished grease represents the extremes of the polymer content. A more useful range of about 0.1 to 0.6 parts by weight of copolymer produces greases which have good properties and consistently pass water resistance tests and therefore are preferred.

The base oil forming the major component of the grease composition may be any oil having lubricating characteristics. Any conventionally refined base stocks derived from paraffinic, naphthenic and mixed mineral oil base crudes can be employed. In general, the naphthenic or paraffinic base oils or their blends will have Saybolt Universal viscosities in the range of from about 35 seconds to 300 seconds at 210° F. When a lubricating oil blend is employed in the grease making process, the oils may be blended as they are being used or they may be blended separately beforehand. The preferred mineral base oils are those having Saybolt Universal viscosities in the range of from about 67 seconds to about 87 seconds at 210° F.; they may be blends of lighter or heavier oils in the lubricating oil viscosity range.

This invention is shown by way of Example.

EXAMPLE 1

Comparative

A grease kettle was charged With 14.0 lbs solvent neutral oil 600 (600 Saybolt@100° F.) and 3.7 lbs diphenylmethane-4,4'-diisocyanate. After heating and mixing under a shear pressure of 100–110 psi, 3.8 lbs octadecylamine and 0.4 lbs ethylenediamine were added and the mixture thickened immediately. The resulting grease was heated with stirring for 3 hours at 375° F. Then, 11.1 lbs solvent neutral oil 600 and grease additives were added slowly to the grease. An NLGI Grade No. 1 grease with a 488° F. dropping point, worked penetration of 347 and 10,000 stroke penetration of 357 was recovered. This grease absorbed 80% water.

EXAMPLE 2

A grease kettle was charged with 14.0 lbs solvent neutral oil 600 (600 Saybolt@100° F.) and 3.7 lbs diphenylmethane-4,4'-diisocyanate. After heating and mixing under a shear pressure of 100–110 psi, 3.8 lbs octadecylamine and 0.4 lbs ethylenediamine were added and the mixture thickened immediately. The resulting grease was heated with stirring for 3 hours at 375° F. Then, 10.9 lbs solvent neutral oil 600, 0.2 lbs copolymer (DPG ®-15) and other additives were added slowly to the grease. An NLGI Grade No. 1 grease with a 527° F. dropping point, worked penetration of 308 and 10,000 stroke penetration of 337 was recovered. This grease absorbed 55% water.

EXAMPLE 3

A grease charged with 14.0 lbs solvent neutral oil 600 (600 Saybolt@100° F.) and 3.7 lbs diphenylmethane-4,4'-diisocyanate. After heating and mixing under a shear pressure of 100–110 psi, 3.8 lbs octadecylamine, 0.4 lbs ethylenediamine and 0.2 lbs copolymer (DPG ®-15) were added and the mixture thickened immediately. The resulting grease was heated with stirring for 3 hours at 375° F. Then, 10.9 lbs solvent neutral oil 600 and grease additives were added slowly to the grease. An NLGI Grade No. 2 grease with a 531° F. dropping point, worked penetration of 255 and 10,000 stroke penetration of 315 was recovered. This grease absorbed 25% water.

EXAMPLE 4

A grease kettle was charged 14.0 lbs solvent neutral oil 600 (600 SUS@100° F.) and 3.7 lbs diphenylmethane-4,4'-diisocyanate. After heating and mixing under a shear pressure of 100–110 psi, 3.8 lbs octadecylamine and 0.4 lbs ethylenediamine were added and the mixture thickened immediately. The resulting grease was heated with stirring for 3 hours at 375° F. Then, 10.9 lbs solvent neutral oil 600, 0.2 lbs Tolad ®9302 and other additives were added slowly to the grease. An NLGI Grade No. 2 grease with a 560° F. dropping point, worked penetration of 293 and 10,000 stroke penetration of 330 was recovered. This grease absorbed 70% water.

EXAMPLE 5

A grease kettle was charged 14.0 lbs solvent neutral oil 600 (600 SUS@100° F.), 0.2 lbs Tolad ®9302 and 3.7 lbs diphenylmethane-4,4'-diisocyanate. After heating and mixing under a shear pressure of 100–110 psi, 3.8 lbs octadecylamine and 0.4 lbs ethylenediamine were then added and the mixture thickened immediately. The resulting grease was heated with stirring for 3 hours at 375° F. Then, 10.9 lbs solvent neutral oil 600 and other additives were added slowly to the grease. An NLGI Grade No. 2 grease with a 562° F. dropping point, worked penetration of 287 and 10,000 stroke penetration of 320 was recovered. This grease absorbed 45% water.

Grease compositions were formed as described above. The composition had the following compositions and properties:

| | Comp. Ex. 1 | Ex. 2 | Ex. 3 | Ex. 4 | Ex. 5 |
|---|---|---|---|---|---|
| Components: Weight % | | | | | |
| SNO 600 | 71.70 | 71.20 | 71.20 | 71.20 | 71.20 |
| Octadecylamine | 10.98 | 10.98 | 10.98 | 10.98 | 10.98 |
| Ethylenediamine | 1.19 | 1.19 | 1.19 | 1.19 | 1.19 |
| Additives | 5.00 | 5.00 | 5.00 | 5.00 | 5.00 |
| DPG ®-15 | 0 | 0.50 | 0.50 | 0 | 0 |
| Tolad ® 9302 | 0 | 0 | 0 | 0.50 | 0.50 |
| Inspections: | | | | | |
| Dropping Point, °F. | 488 | 527 | 531 | 560 | 562 |
| Penetration | | | | | |
| Unworked | 325 | 275 | 215 | 275 | 250 |
| Worked | | | | | |
| 60 | 347 | 308 | 255 | 293 | 287 |
| 10K | 357 | 337 | 315 | 330 | 320 |
| 100K | 373 | 353 | 330 | 337 | 325 |
| % Change (60 vs 100K) | 7.5 | 14.6 | 29.4 | 15.0 | 13.2 |
| Water Absorption, Wt % | 80 | 55 | 25 | 70 | 55 |
| Worked Penetration | | | | | |
| Original | 317 | 287 | 230 | 283 | 268 |
| Wet | 335 | 313 | 268 | 309 | 302 |
| Rust Prevention, 5% SSW | 1-1-1 | 1-1-1 | 1-1-1 | 3-3-3 | 3-3-3 |
| Copper Corrosion | 1a | 1a | 1a | 1a | 1a |
| PDSC, Temp. Prog. | | | | | |
| First Deviation, °C. | 217 | 215 | 217 | 206 | 226 |
| Extrapolated Onset, °C. | 264.1 | 262.4 | 262.8 | 262.7 | 263.8 |

TABLE OF COMPOUNDS

| | |
|---|---|
| SNO 600 | lubricating oil - 600 Saybolt @ 100° F. |
| DPG ®- 15 | copolymer of polyoxyethylene glycol and polyoxypropylene glycol |
| Tolad ® 9302 | polyoxyalkylene diamine |

TABLE OF TEST METHODS

| | |
|---|---|
| Dropping Point | ASTM D-2265-88 Equivalent |
| Water Absorption | Texaco Test SP-344 |
| Rust Prevention (5% Synthetic Sea Water - SSW) | ASTM D-1743, Modified |
| Copper corrosion | ASTM D-4048 |
| PDSC, Temp. Prog. | Pressure Differential Scanning Calorimetry |

NLGI Grease Classification ASTM D-217

NLGI Grade No. 1 - 310 to 340 Penetration
NLGI Grade No. 2 - 265 to 295 Penetration
NLGI Grade No. 3 - 220 to 250 Penetration While particular embodiments of the invention have been described, it will be understood, of course, that the invention is not limited thereto since many modifications may be made, and it is, therefore, contemplated to cover by the appended claims any such modifications as fall within the true spirit and scope of the invention.

What is claimed is:

1. A grease composition comprising a lubricating oil and a thickener, characterized in that the thickener is a polyurea compound prepared by reacting a diisocyanate compound with a monoamine, a diamine and a copolymer of polyoxyethylene glycol and polyoxypropylene glycol having a molecular weight of from 300 to 15,000.

2. The grease composition of claim 1 wherein 100 parts by weight of the grease composition comprises 0.1 to 5 parts weight of the copolymer.

3. The grease composition of claim 1 wherein 100 parts by weight of the grease composition comprises 0.1 to 0.6 parts by weight of the copolymer.

4. The grease composition of claim 1 wherein the copolymer has a molecular weight of 1500 to 10,000.

5. The grease composition of claim 1 wherein the copolymer comprises 75 to 90 parts by weight of propoxy groups and 25 to 10 parts by weight of ethoxy groups.

6. The grease composition of claim 1 wherein when a copolymer of polyoxyethylene glycol and polyoxypropylene glycol is added prior to heating, an improved yield and water absorption is realized.

7. A grease composition comprising a lubricating oil and a thickener, characterize in that the thickener is a polyurea compound prepared by reacting a diisocyanate compound with a monoamine, a diamine and a copolymer of polyoxyethylene glycol and polyoxypropylene glycol having a molecular weight of 1500 to 10,000 and wherein 100 parts by weight of the grease composition comprises 0.1 to 0.6 parts by weight of the copolymer and wherein the copolymer comprises 75 to 90 parts by weight of propoxy groups and 25 to 10 parts by weight of ethoxy groups.

8. A grease composition comprising a lubricating oil and a thickener, characterized in that the thickener is a polyurea compound prepared by reacting a diisocyanate compound with a monoamine, a diamine and a polyoxyalkylene diamine having a molecular weight of from 500 to 18,000.

9. The grease composition of claim 8 wherein 100 parts by weight of the grease composition comprises 0.1 to 5 parts weight of the polyoxyalkylene diamine.

10. The grease composition of claim 8 wherein 100 parts by weight of the grease composition comprises 0.1 to 0.6 parts by weight of the polyoxyalkylene diamine.

11. The grease composition of claim 8 wherein the polyoxyalkylene diamine has a molecular weight of 3000 to 12,000.

12. The grease composition of claim 8 wherein the polyoxyalkylene comprises 75 to 90 parts by weight of propoxy groups and 25 to 10 parts by weight of ethoxy groups.

13. The grease composition of claim 8 wherein when a polyoxyalkylene diamine is added prior to heating, an improved yield and water adsorption is realized.

14. A grease composition comprising a lubricating oil and a thickener, characterize in that the thickener is a polyurea compound prepared by reacting a diisocyanate compound with a monoamine, a diamine and a polyoxyalkylene diamine having a molecular weight of 3000 to 12,000 and wherein 100 parts by weight of the grease composition comprises 0.1 to 0.6 parts by weight of the polyoxyalkylene diamine and wherein the polyoxyalkylene diamine comprises 75 to 90 parts by weight of propoxy groups and 25 to 10 parts by weight of ethoxy groups.

* * * * *